US009592928B2

(12) United States Patent
Strzelczyk

(10) Patent No.: US 9,592,928 B2
(45) Date of Patent: Mar. 14, 2017

(54) RECLOSING MECHANISM FOR CONTAINERS, PARTICULARLY BEVERAGE CONTAINERS

(71) Applicant: Mieczyslaw Strzelczyk, Leszno (PL)

(72) Inventor: Mieczyslaw Strzelczyk, Leszno (PL)

(73) Assignee: REEND SP. Z O.O., Krzemieniowo (PL)

( * ) Notice: Subject to any disclaimer, the term of this patent is extended or adjusted under 35 U.S.C. 154(b) by 100 days.

(21) Appl. No.: 14/758,409

(22) PCT Filed: Jun. 24, 2013

(86) PCT No.: PCT/PL2013/000084

§ 371 (c)(1),
(2) Date: Jun. 29, 2015

(87) PCT Pub. No.: WO2014/003586

PCT Pub. Date: Jan. 3, 2014

(65) Prior Publication Data

US 2015/0353230 A1 Dec. 10, 2015

(30) Foreign Application Priority Data

Jun. 27, 2012 (PL) ..... 399690

(51) Int. Cl.
*B65D 17/00* (2006.01)
*B65D 17/50* (2006.01)
*B65D 43/20* (2006.01)

(52) U.S. Cl.
CPC ..... *B65D 17/166* (2013.01); *B65D 17/506* (2013.01); *B65D 43/20* (2013.01)

(58) Field of Classification Search
CPC ..... B65D 51/18; B65D 43/20; B65D 43/16; B65D 43/12; B65D 41/026; B65D 17/506;

(Continued)

(56) References Cited

U.S. PATENT DOCUMENTS 2,747,761 A * 5/1956 Staples ..... B65D 51/145 215/315
3,977,578 A 8/1976 Perry
(Continued)

FOREIGN PATENT DOCUMENTS

EP 0023525 2/1981
FR 2140373 1/1973
(Continued)

OTHER PUBLICATIONS

International Search Report dated Apr. 11, 2014 from corresponding Application No. PCT/PL2013/000084.

*Primary Examiner* — Robert J Hicks
(74) *Attorney, Agent, or Firm* — Katten Muchin Rosenman LLP

(57) ABSTRACT

The reclosing mechanism for containers, particularly beverage containers, has the latch (3) fitted slidingly in the opening (5). Formed on the top side of the latch (3) there is an attachment (14) shorter than the opening (5) and narrower than the latch (3), where the attachment (14) is fitted with a pull tab (4) longer than the attachment (14) and fixed to the attachment (14) with a hinge (6) and a connector (7) which serves as the seal before the first opening. Formed on the opposite longitudinal sides of the attachment (14) there are catches (8) fitted slidingly on the guides (13) formed on the longer side walls of the opening (5). On the top surface of the element in which the opening (5) is made there are protrusions (10) formed on the side of the pull tab (4) front, on which the pull tab (4) rests and blocks the sliding of the latch (3) in the closed position.

9 Claims, 8 Drawing Sheets

Figure 1:
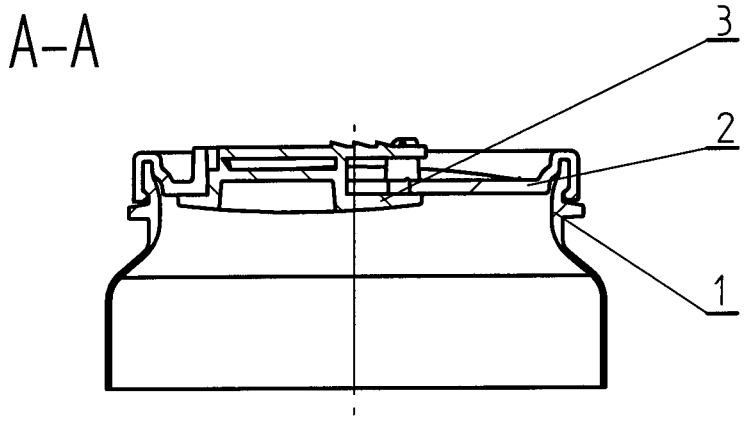

(58) Field of Classification Search
CPC .... B65D 17/50; B65D 17/166; B65D 17/165; B65D 17/163; B65D 17/16
USPC ..... 220/254.9, 254.1, 812, 811, 810, 259.5, 220/256.1, 345.4, 345.1, 278, 277, 270, 220/266, 284, 906; 215/322, 316, 228
See application file for complete search history.

(56) References Cited

U.S. PATENT DOCUMENTS

| | | | | |
|---|---|---|---|---|
| 4,170,724 | A | 10/1979 | Waterbury | |
| 4,746,032 | A | 5/1988 | Huang | |
| 2011/0315684 | A1 | 12/2011 | Bratsch | |
| 2012/0067889 | A1* | 3/2012 | Lai ..... | B65D 25/22 220/254.1 |

FOREIGN PATENT DOCUMENTS

| | | |
|---|---|---|
| WO | 98/12118 | 3/1998 |
| WO | 2004/056667 | 7/2004 |
| WO | 2011/026991 | 3/2011 |

* cited by examiner

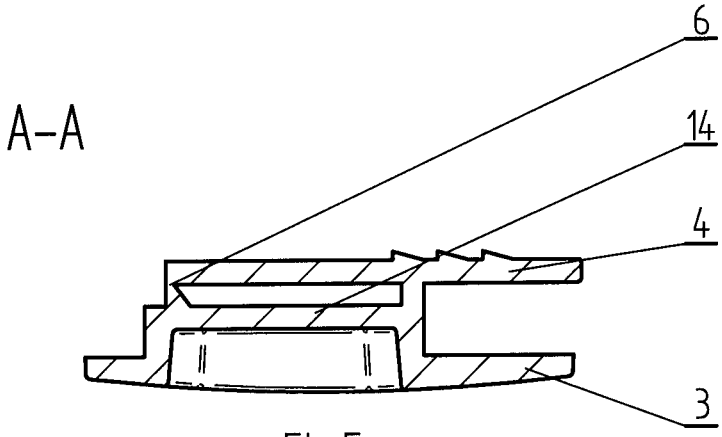
Fig.5
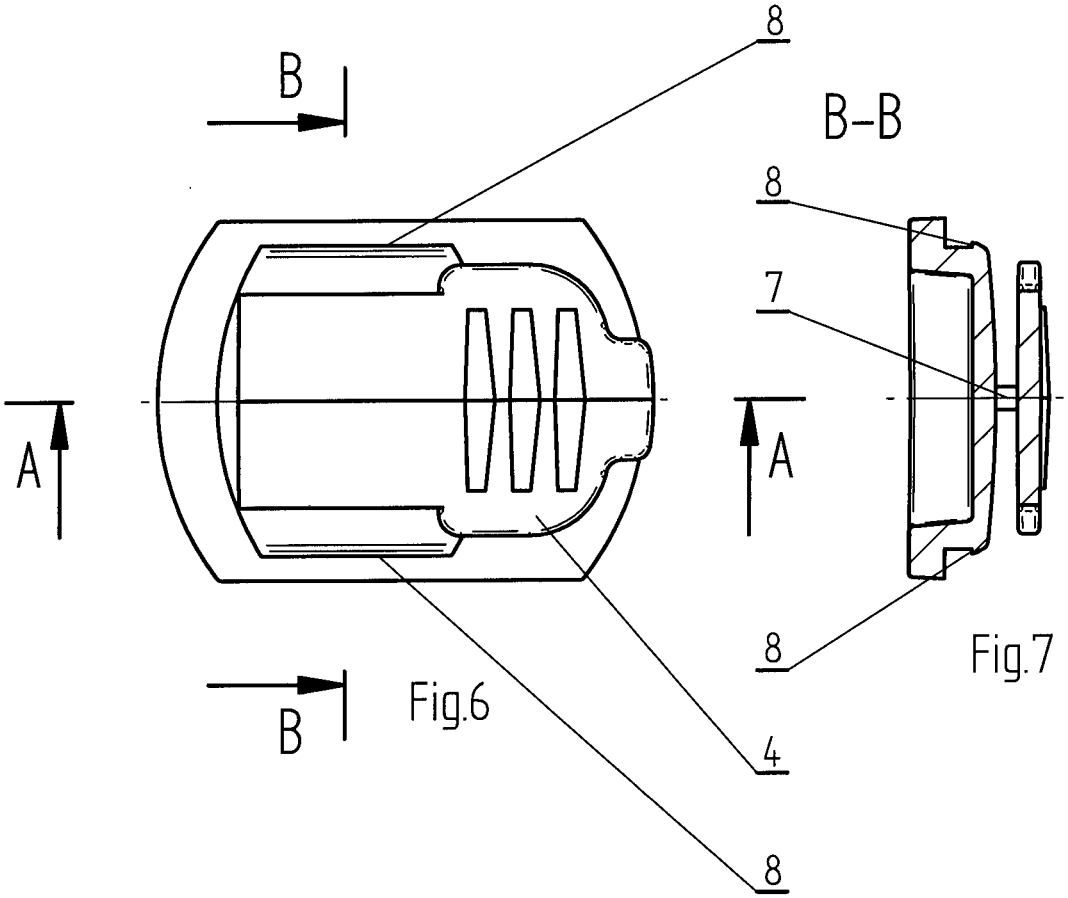
Fig.6
Fig.7

RECLOSING MECHANISM FOR CONTAINERS, PARTICULARLY BEVERAGE CONTAINERS

The invention concerns a reclosing mechanism for containers, particularly beverage containers. The mechanism is suitable for containers of any structure, including cans and carton containers.

Known from the international patent application PCT/DE97/02061 (WO 98/12118) is a container cover, particularly of a beverage can, tightly closing the container, composed of at least two elements, where the first element has a tightly closing flap at the base, removable at least partially or severable so as to open the container and uncover its opening, whereas the other element has an additional opening positioned at the same distance from the central axis of the cover as the tightly closing flap or the container opening. One of the two elements is fixed firm and tight to the container body, whereas the other may rotate along the central axis of the container body from position one, in which the additional opening matches tightly the closing flap or container opening, to position two, in which the tightly closing flap or container opening is closed tight by the respective second element or its base.

Also known from international patent application PCT/EP2003/014675 (WO 2004/056667) is a reclosing cover, particularly of a beverage can. According to this solution, the cover has a severable section encircled with a predefined severance line and a pull tab fixed so as to allow its rotation to the cover plate. The protrusion for fixing the pull tab has a freely twisted element, and at the bottom of the pulling section of the pull tab there is a flat closing attachment intended for reclosing the opening.

Known from international patent application PCT/EP2010/063097 (WO2011/026991) is a container cover, particularly for a pressurized beverage can, in which the outflow opening is closed with an elastic closing pipe element by moving the triggering element from the closed position to the open position, where the pipe element cooperates with the pressure balancing mechanism. The pipe element is closed tight by narrowing it crosswise when the triggering element is in its closed position.

Known from international patent application PCT/EP2010/052192 (US 2011/0315684 A1) is a cover for containers, particularly beverage cans, which includes a closing element made of elastic material, positioned entirely at the bottom side of the cover and partially integrated with it in such a manner as to protect it against twisting, fitted with a triggering mechanism fixed to the outer surface of the cover via an attachment. When the triggering mechanism is moved, the part of the closing mechanism which covers the opening turns perpendicular to the cover surface. The opening can be re-closed by moving the triggering mechanism. In this solution, the outflow opening is sealed before the first use. The seal takes the form of a pin or label which needs to be torn off to uncover the beverage outflow opening.

The structure of the known cover closings is complicated, and their production is costly.

The purpose of this invention is to develop a simple hermetic structure of a reclosing mechanism intended particularly for pressurized and non-pressurized beverage containers, which would enable repeated closing and opening of the outflow opening, characterised by its universal application, easy manipulation by the user, and simplicity of the manufacturing process, which will contribute substantially to reducing the manufacturing cost compared to the known solutions.

Reclosing mechanism for containers, particularly beverage containers, sealed before the first opening, containing a latch to open and reclose the beverage outflow opening according to the invention is characterised in that the latch is fitted slidingly in the beverage outflow opening, where formed on the top side of the latch there is an attachment shorter than the opening and narrower than the latch, where the attachment is fitted with a pull tab longer than the attachment and fixed to the attachment with a hinge, preferably a membrane hinge, and a connector which serves as the seal before the first opening, with catches formed on the opposite longitudinal sides of the attachment fitted slidingly on the guides formed on the longer side walls of the opening. In the closed position, the top surface around the edge of the latch adheres to the bottom surface around the opening, thus sealing it, while on the top surface of the element in which the opening is made there are protrusions formed on the side of the pull tab front, on which the pull tab rests and blocks the sliding of the latch in the closed position. Preferably, at least one of these protrusions has a bulb to prevent pull tab's sliding past the protrusions. Moreover, there is a characteristic click heard when the opening is reclosed and the pull tab positioned below the bulb, which confirms that the pull tab has been positioned below the bulb.

Preferably, on the top surface of the element in which the opening is made there is a protrusion formed on the side of the pull tab hinge, on which the pull tab rests when the sliding of the latch from the closed position starts. Preferably, the protrusions formed on the top surface of the element in which the opening is made are of the height at least equal to the height determined by the top surface of the pull tab in its position before the first opening.

Moreover, there are additional shaped profiles formed on the surface around the opening, or on that part of the surface which adheres to the surface of the latch or its respective part, and/or on the surface of the latch or its part adhering to the surface around the opening or to its respective part.

In the area of the contact point of the latch and the surface around the opening the reclosing mechanism may be additionally sealed with a sealing coat.

The opening may be formed in the lid of container, e.g. can, or in a separate element fixed to the container, e.g. a carton box, or made in the container wall.

Preferably, the reclosing mechanism is made of plastic and the latch is made as a single integrated element formed in the single injection process.

The reclosing mechanism according to the invention meets the intended purposes.

Figure 2:
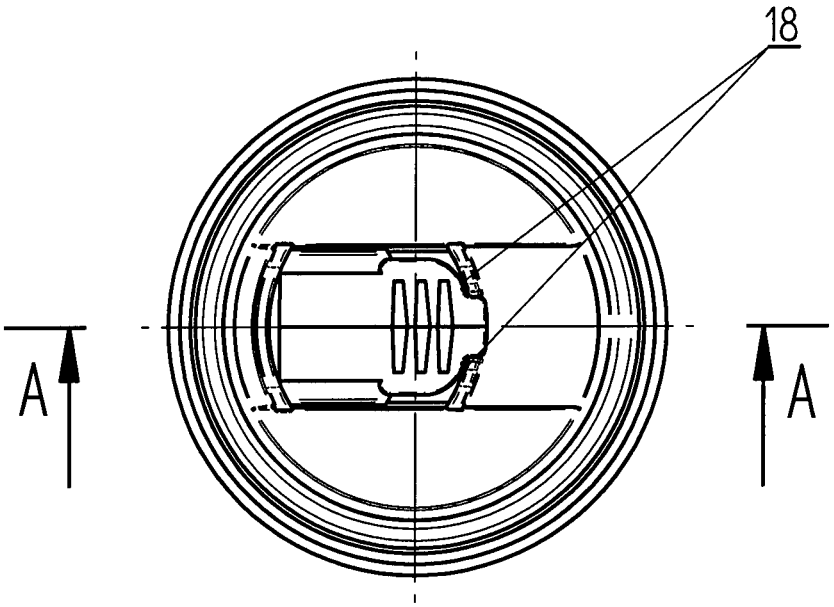
Figure 3:
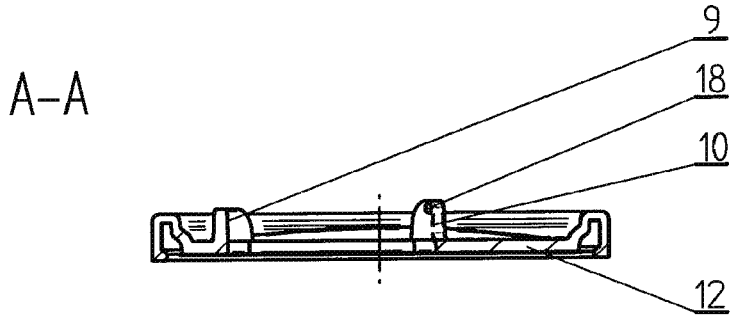
Figure 4:
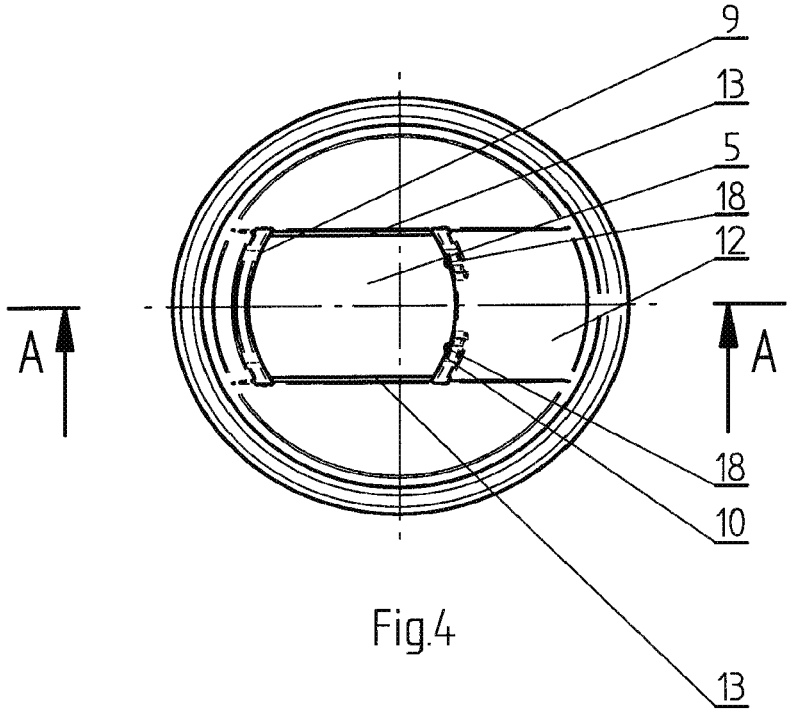

An exemplary embodiment of the invention incorporated in a beverage can lid is presented on a drawing, in which:

FIG. 1 shows the beverage can lid with the reclosing mechanism in vertical longitudinal section along the A-A plane marked on FIG. 2, FIG. 2—top view of the lid with the reclosing mechanism, FIG. 3—the lid with the opening without the latch mounted, in vertical longitudinal section along the A-A plane marked on FIG. 4, FIG. 4—top view of the lid with the opening without the latch mounted, FIG. 5—the latch in vertical longitudinal section along the A-A plane marked on FIG. 6, FIG. 6—top view of the latch, FIG. 7—the latch in vertical cross-section along the B-B plane marked on FIG. 6

Figure 8:
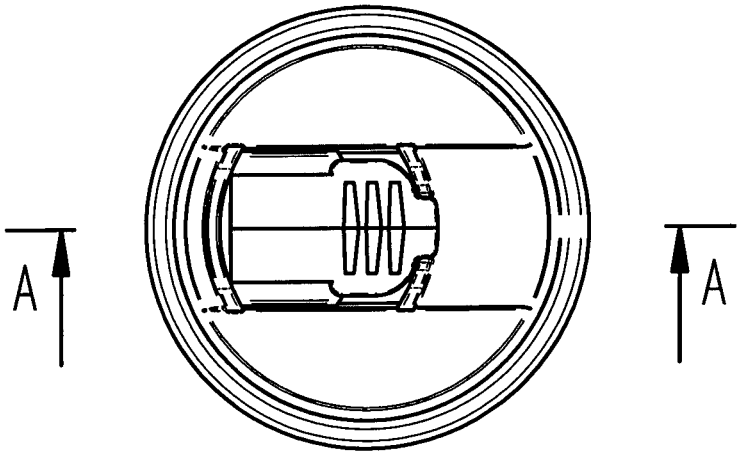

FIG. 8—contact point of the latch surface and the surface around the opening with the shaped profile in the form of an offset along the rim and with the sealing—top view.

Figure 9:
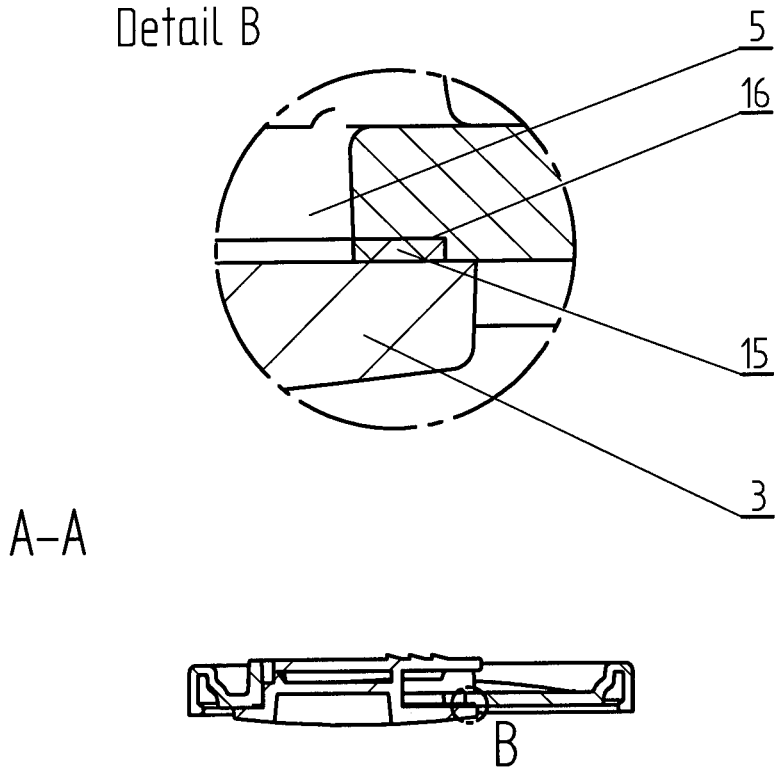
Figure 11:
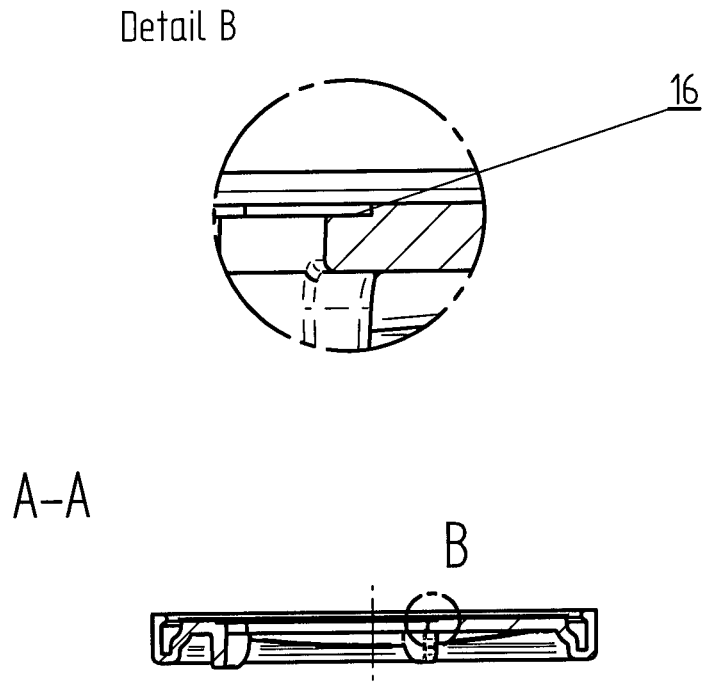
Figure 10:
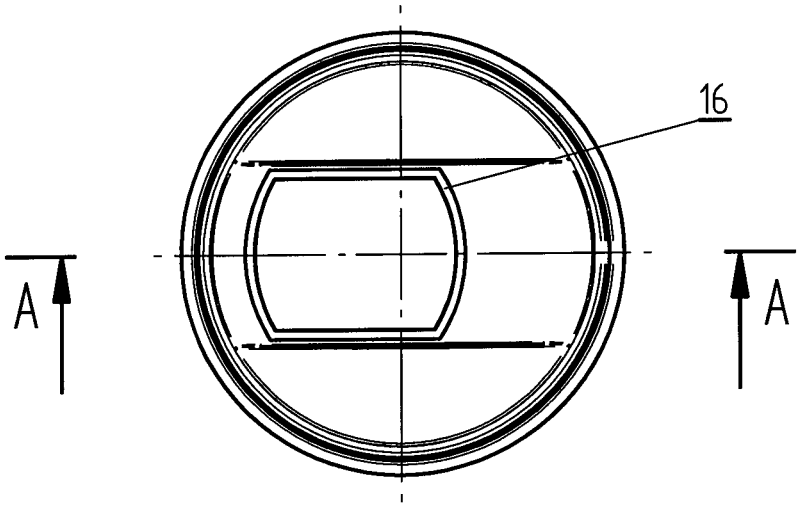
Figure 13:
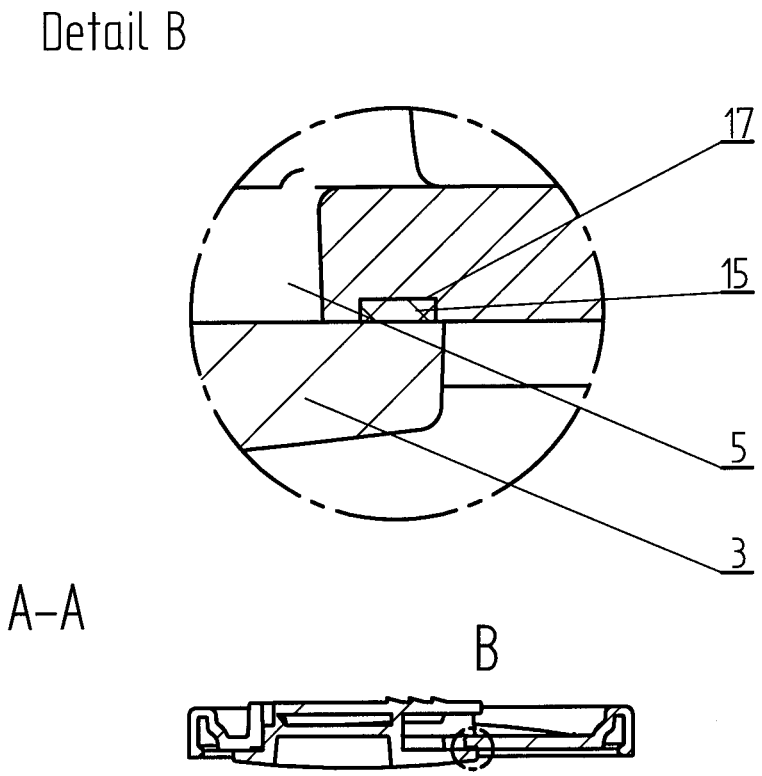
Figure 12:
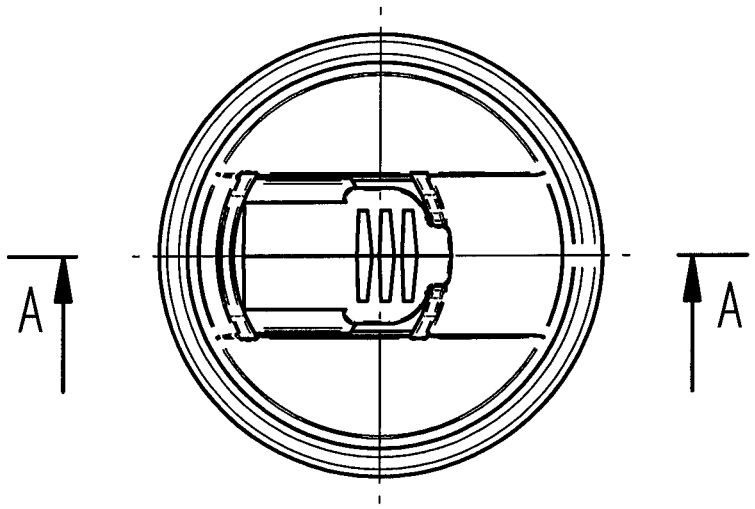
Figure 15:
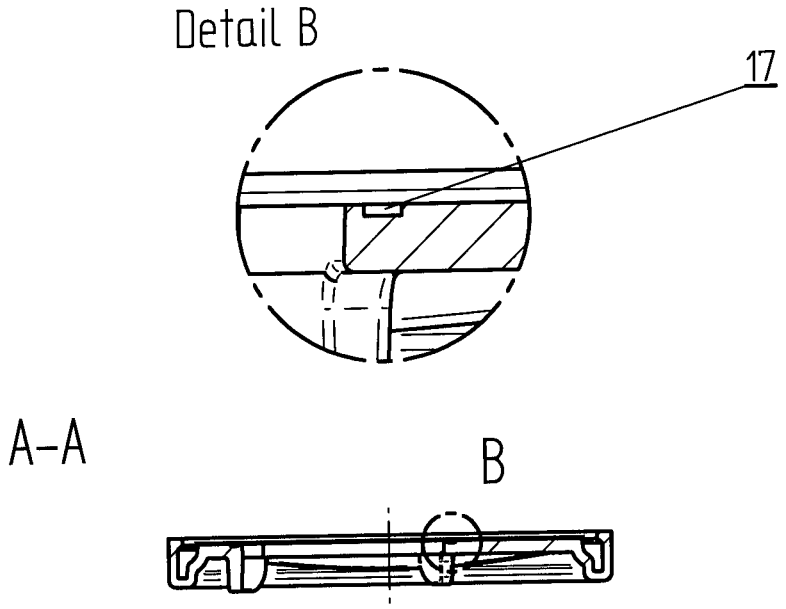
Figure 14:
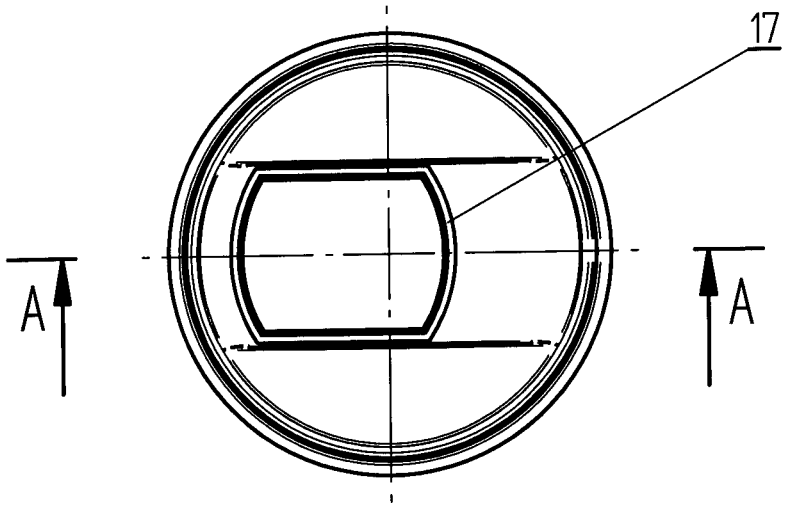

FIG. 9—the lid with the reclosing mechanism and the shaped profile in the form of an offset along the opening rim and the sealing, in vertical longitudinal section along the A-A plane marked on FIG. 8, and detail B enlarged, FIG. 10—the lid with the opening without the latch mounted, with the shaped profile in the form of an offset around the opening, its bottom side in bird's eye view, FIG. 11—the lid with the shaped profile in the form of an offset around the opening, in vertical longitudinal section along the A-A plane marked on FIG. 10, and detail B enlarged, FIG. 12—top view of the contact point between the surface of the latch and the surface around the opening with the shaped profile in the form of a groove, and with the sealing, FIG. 13—the lid with the reclosing mechanism, with the shaped profile in the form of a groove around the opening, and with the sealing, shown in vertical longitudinal section along the A-A plane marked on FIG. 12, and detail B enlarged, FIG. 14—the lid with the opening without the latch mounted, with the shaped profile in the form of a groove around the opening, its bottom side seen in bird's eye view, FIG. 15—the lid with the opening without the latch mounted, with the shaped profile in the form of a groove around the opening, in vertical longitudinal section along the A-A plane marked on FIG. 14, and detail B enlarged.

Figure 16:
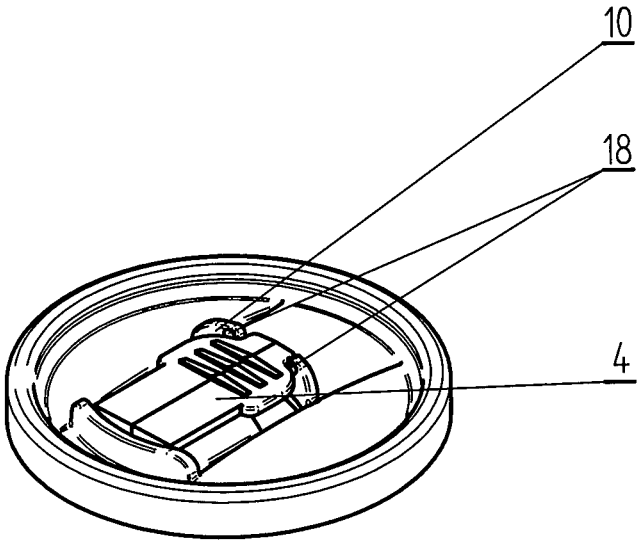

FIG. 16—view of the lid

In one embodiment of the invention, the reclosing mechanism is made of plastic in the lid 2 of a can 1 (FIGS. 1 to 7). The reclosing mechanism is equipped with a latch 3, which is fitted slidingly in the opening 5, and around the rim it adheres with its top flat surface to the bottom flat surface 12 formed on the bottom side of the lid 2. Formed on the top side of the latch 3 there is an attachment 14 shorter than the opening 5 and narrower than the latch 3, where the surface of the latch 3 around the attachment 14 is flat. The attachment 14 is fitted with a pull tab 4 to unseal the container and slide the latch 3. The pull tab 4 is longer than the attachment 14. The pull tab 4 is fixed to the attachment 14 with a membrane hinge 6 and a connector 7 which serves as the seal before the first opening. Formed on the opposite longitudinal sides of the attachment 14 there are catches 8 fitted slidingly on the guides 13 formed on the longer side walls of the opening 5 so that when in the closed position, the tope flat surface around the edge of the latch 3 adheres to the bottom flat surface around the opening 5, thus sealing it. On the top surface of the lid 2 there are two protrusions 10 formed on the side of the pull tab 4 front, on which the pull tab 4 rests and blocks the sliding of the latch 3 in the closed position. The protrusions 10 have a bulb 18 to prevent pull tab's 4 sliding past the protrusions, where there is a characteristic click heard when the opening is reclosed, which confirms that the pull tab has been positioned below the bulb. On the top surface of the lid 2, there is a protrusion 9 formed on the side of the hinge 6, on which the pull tab 4 rests when the sliding of the latch from the closed position starts. The protrusions 9 and 10 reach slightly higher than the height determined by the top surface of the pull tab 4 in the closed position. Thanks to that, the top surfaces of the protrusions 9 and 10 can support the subsequent containers stacked one on top of another while eliminating the risk of damaging the pull tab 4 and the connector 7 (the seal).

In another embodiment of the invention the reclosing mechanism described in example one is additionally sealed with a sealing coat covering the bottom of the surface around the opening 5 in the latch 3 contact area.

In other embodiments of the invention the reclosing mechanism described in example one has an additional shaped profile on the surface around the opening 5 touching on the latch 3 in the form of an offset 16 (FIG. 10, 11) around the rim of the opening 5, or in the form of a groove 17 (FIG. 14, 15), which as the result of being covered with the sealing coat become filled with a susceptible (elastic, resilient) sealant 15 (FIG. 8, 9, 12, 13).

In all possible embodiments of the invention the latch 3 is made of plastic, preferably as a single integrated element formed in the single injection process.

In all possible embodiments of the invention, the opening 5 may be formed in the lid 2, as shown in the above exemplary embodiments, or in a separate element fixed to the container, e.g. a carton box, or made in the container wall.

The latch 3 is fitted in the opening 5 by pressing it into the opening 5 from the bottom side, so that the catches 8 are introduced into the guides 13, and the pull tab 4 is placed between the protrusions 9 and 10. The reclosing mechanism may be additionally sealed before assembling by covering latch 3 contact surface around the opening 5 with a sealing coat 15.

In order to open the reclosing mechanism one lifts the pull tab 4 up, thus breaking the connector 7 and turning the pull tab 4 up on the hinge 6. In effect of the rotation, the edge of the pull tab 4 presses on the protrusion 9, thus sliding the latch 3 and unsealing the container. Pulling the pull tab 4 towards the protrusions 10 results in sliding the latch 3 and uncovering the opening 5. The opening 5 may be reclosed by pulling the pull tab 4 towards the protrusion 9, and then by pressing the pull tab behind the bulbs of the protrusions 10. There is a characteristic click heard, which confirms that the opening 5 has been closed.

The invention claimed is:

1. A reclosing mechanism for a container sealed before a first opening of the container, the reclosing mechanism comprising:

a latch to open and reclose an outflow opening of the container, wherein the latch is fitted slidingly in the outflow opening, wherein a top surface of the latch comprises an attachment shorter than the outflow opening and narrower than the latch, wherein the attachment comprises:

a pull tab longer than the attachment and connected to the attachment with:

a hinge that allows the pull tab to rotate relative to the attachment about a fixed axis, wherein the fixed axis is parallel to the top surface of the latch and the outflow opening; and a breakable connector which connects the pull tab to the attachment prior to the first opening, wherein the breakable connector is broken during the first opening, wherein the outflow opening comprises guides formed on opposing sides of the outflow opening which are slidingly fitted with catches formed on opposite longitudinal sides of the attachment to allow the attachment to slide within the outflow opening, wherein, in a closed position, the top surface of the latch adheres to a bottom surface of the outflow opening to seal the outflow opening, and wherein a top surface of the outflow opening comprises protrusions formed on a front side of the pull tab, wherein, in the closed position, the front of the pull tab rests on the protrusions to block sliding of the latch in the outflow opening.

2. The reclosing mechanism according to claim 1, wherein the hinge is a membrane hinge.

3. The reclosing mechanism according to claim 2, wherein at least one of the protrusions further comprises a bulb along a top surface of the at least one of the protrusions to prevent the pull tab from sliding past the protrusions.

4. The reclosing mechanism according to claim 1, wherein the top surface of the outflow opening further comprises a second protrusion formed on a side of the hinge, wherein the pull tab rests on the second protrusion when sliding of the latch from the closed position to an opened position begins.

5. The reclosing mechanism according to claim 4, wherein the protrusions and the second protrusion are of a height at least equal to a height of a top surface of the pull tab in when the reclosing mechanism is in the closed position.

6. The reclosing mechanism according to claim 1, wherein the top surface of the outflow opening further comprises:

shaped profiles formed around a rim of the outflow opening.

7. The reclosing mechanism according to claim 1, wherein the latch is further sealed to the outflow opening with a sealing coat.

8. The reclosing mechanism according to claim 1, wherein the latch is made of plastic.

9. The reclosing mechanism according to claim 8, wherein the latch is made as a single integrated element formed in a single injection process.

* * * * *